US005358312A

United States Patent [19]

Drumm

[11] Patent Number: 5,358,312

[45] Date of Patent: Oct. 25, 1994

[54] METHOD OF MAKING A STRIP BRUSH FOR MOUNTING OF A ROTARY DRUM

[76] Inventor: Arthur E. Drumm, 14808 Hillview Rd., Marysville, Ohio 43040

[21] Appl. No.: 167,083

[22] Filed: Dec. 16, 1993

Related U.S. Application Data

[60] Continuation-in-part of Ser. No. 132,099, Oct. 5, 1993, Pat. No. 5,358,311, which is a division of Ser. No. 958,799, Oct. 9, 1992, Pat. No. 5,251,355, which is a continuation-in-part of Ser. No. 777,905, Oct. 17, 1991, Pat. No. 5,160,187.

[51] Int. Cl.[5] ..... A46D 3/00

[52] U.S. Cl. ..... 300/21; 15/183

[58] Field of Search ..... 300/21; 15/179, 182, 15/183, 199

[56] References Cited

U.S. PATENT DOCUMENTS

| | | |
|---|---|---|
| 2,136,103 | 11/1938 | Herold . |
| 2,303,386 | 12/1942 | Peterson . |
| 2,511,004 | 6/1950 | Peterson . |
| 2,757,400 | 8/1956 | Peterson . |
| 2,767,418 | 10/1956 | Lombardi . |
| 2,778,047 | 1/1957 | Nielsen . |
| 2,778,048 | 1/1957 | Nielsen . |
| 2,921,329 | 1/1960 | Peterson . |
| 2,978,726 | 4/1961 | Park . |
| 3,002,212 | 10/1961 | Tilgner . |
| 3,241,172 | 3/1966 | Tilgner . |
| 3,715,773 | 2/1973 | Drumm . |
| 3,862,462 | 11/1975 | Reiter . |
| 4,142,267 | 3/1979 | Clark . |
| 4,490,877 | 1/1985 | Drumm . |
| 4,498,210 | 2/1985 | Drumm . |
| 4,955,102 | 9/1990 | Cousins . |
| 5,045,091 | 9/1991 | Abrahamson et al. . |
| 5,160,187 | 11/1992 | Drumm . |

FOREIGN PATENT DOCUMENTS

| | | |
|---|---|---|
| 82431 | 11/1956 | Denmark . |
| 1093323 | 11/1960 | Fed. Rep. of Germany . |
| 2218914 | 10/1973 | Fed. Rep. of Germany . |
| 2707673 | 8/1978 | Fed. Rep. of Germany . |
| 710230 | 6/1954 | United Kingdom . |
| 779845 | 7/1957 | United Kingdom . |
| 780225 | 7/1957 | United Kingdom . |
| 790826 | 2/1958 | United Kingdom . |

*Primary Examiner*—Mark Rosenbaum
*Assistant Examiner*—Frances Han
*Attorney, Agent, or Firm*—Sidney W. Millard

[57] ABSTRACT

A bristle strip for rotary brushes comprising a supporting channel in which the closed ends of U-shaped bristles are clamped. The channel is provided with laterally-extending guide members mounted directly thereon that project laterally outwardly beyond its side flanges to guide the strip when it is inserted in a guide track on a rotary drum and to retain it therein.

8 Claims, 4 Drawing Sheets

FIG. 1
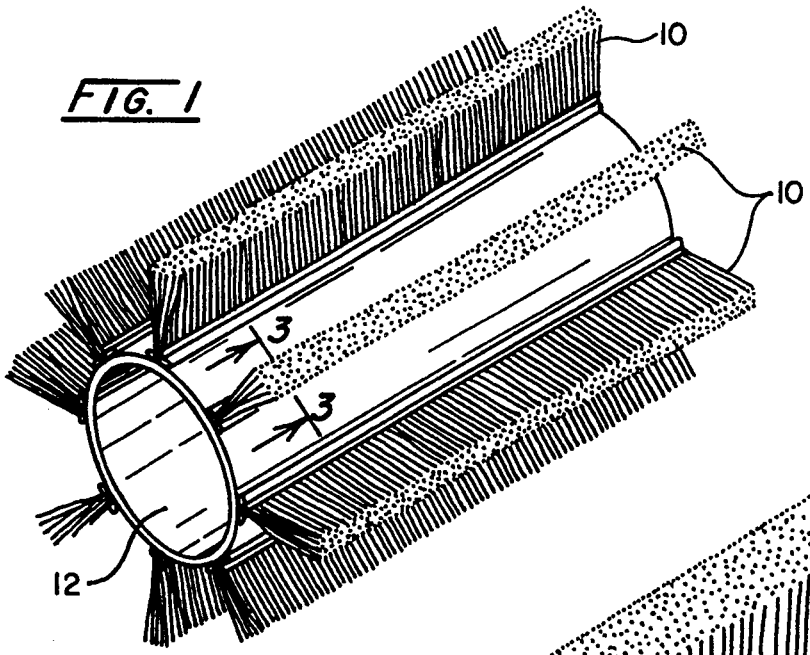
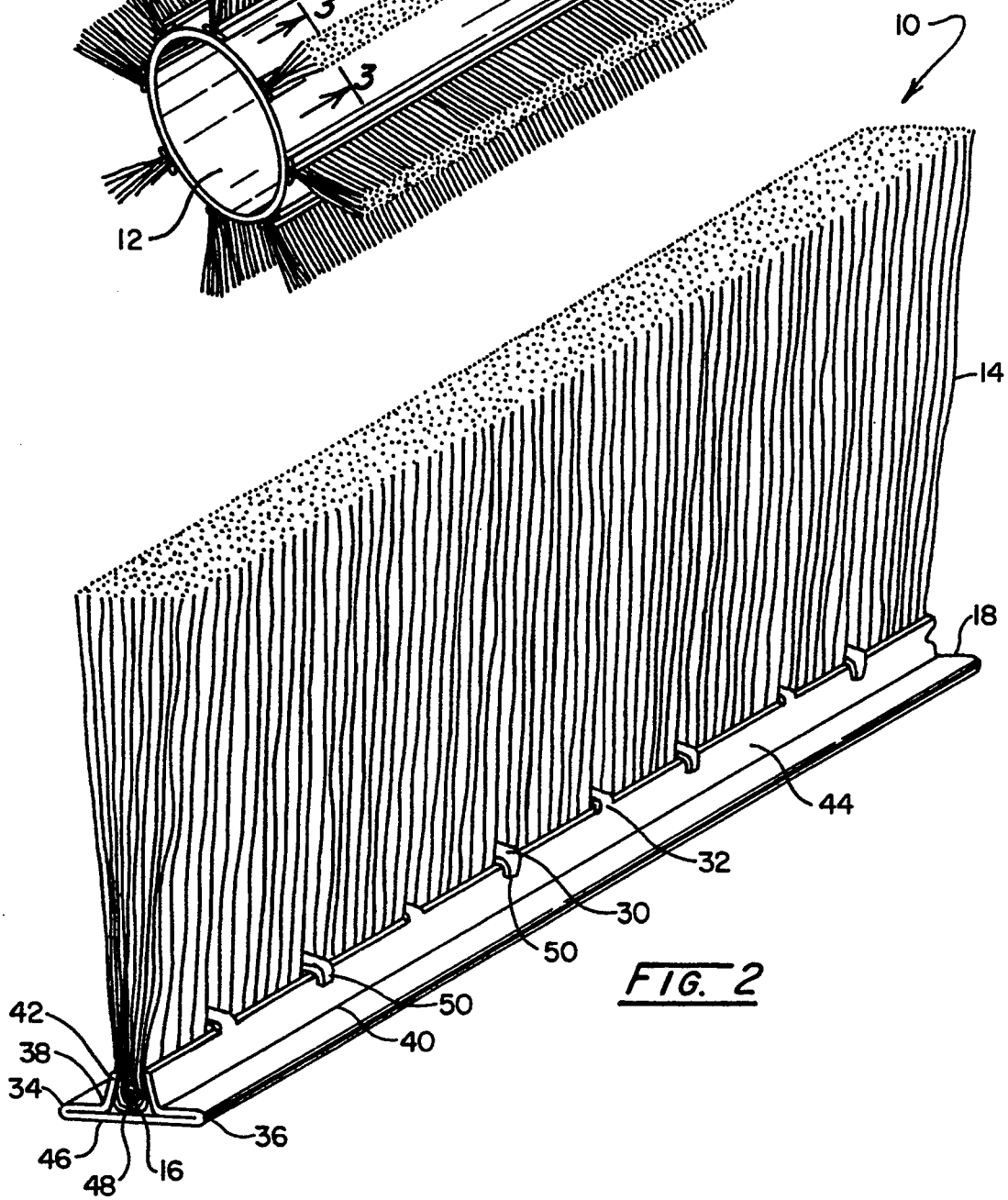
FIG. 2

METHOD OF MAKING A STRIP BRUSH FOR MOUNTING OF A ROTARY DRUM

This is a continuation-in-part of application Ser. No. 08/132,099, filed Oct. 5, 1993, now U.S. Pat. No. 5,358,311, which is a divisional of application Ser. No. 07/958,799, filed Oct. 9, 1992, now U.S. Pat. No. 5,251,355, which is a continuation-in-part of application Ser. No. 07/777,905, filed Oct. 17, 1991, now U.S. Pat. No. 5,160,187.

FIELD OF THE INVENTION

This invention relates to rotary brushes of the type comprising a rotary drum with strips of bristles mounted on its periphery. The strips are mounted in tracks on the drum and can be removed for replacement when worn.

BACKGROUND OF THE INVENTION

Rotary brushes now commonly on the market and in use consist of a drum which carries bristle strips on its periphery. The strips are mounted in various ways on the drum and are usually removable so that they can be replaced after wear. It is important that the strip be of such a nature that it can be produced with simple tooling and at a low cost of time and material.

A present method of making a rotary sweeper includes forming a strip for sliding into a track secured on the drum periphery by double-joining, back-forming, etc. to provide an outwardly-opening, bristle-receiving channel with laterally-extending lower flanges adapted to slip in the laterally-extending grooves of the drum-mounted tracks. This method requires expensive tooling and produces a weak retaining arrangement that results in a leverage problem during rotation of the drum tending to cause the flanges of the outwardly-opening bristle-receiving channel to spring apart and thereby release the bristles.

This invention provides a strip which can slip in any guide track that provides laterally-opposed receiving guide grooves which extend longitudinally of the track.

The present invention further provides a strip brush for mounting on a rotary drum which is of simple construction and can be removably slipped into tracks of the type now conventionally provided on rotary drums. This bristle strip can be produced without high-cost materials, and expensive tooling and time-consuming operations resulting in a low cost strip. It can be inserted readily into the drum track, will be effectively retained therein and can be removed with ease when it is necessary to replace it. The bristle strip is stronger and easier to install and remove as compared to prior art strips and is less costly to produce.

SUMMARY OF THE INVENTION

The bristle strip of this invention is of channel form and receives a mat of bristles of U-form having a retaining wire running through the closed end of the U-shape with the open end of the bristles in position to sweep debris from a surface as in the prior art. This mat of bristles is retained in the carrying channel by crimping of the sides or flanges of the channel. The channel is provided with guide means for fitting into the drum-carried track in the form of laterally-extending guide members which project laterally outwardly beyond the upstanding flanges of the channel. These guide members slip directly into the laterally-opposed continuous receiving guide grooves of the drum mounted track.

This invention is an advance in the art, in that, it forms the bristle holding flanges and the transversely extending guide members or ears completely from one strip of metal by appropriate deformation.

Additionally, structure is provided to mechanically secure the mat of U-shaped bristles within the deformed strip of metal.

Objects of the invention not clear from the above will be fully understood upon a review of the drawings and a description of the preferred embodiment which follows.

BRIEF DESCRIPTION OF THE DRAWINGS

The best mode contemplated in carrying out this invention is illustrated in the accompanying drawings in which:

FIG. 1 is a perspective view of a drum having a plurality of bristle strips mounted thereon in straight parallel angularly spaced relationship;

FIG. 2 is an enlarged perspective view of a single bristle strip of one form of this invention;

DETAILED DESCRIPTION OF THE PREFERRED EMBODIMENT

Figure 3:
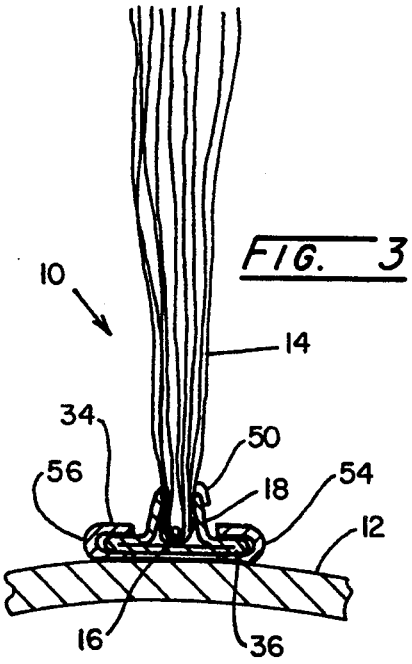
FIG. 3 is a transverse sectional view taken along line 3—3 of FIG. 1 having one type of drum track into which the bristle strip of this invention is slipped.

With reference to FIGS. 1 and 2, a plurality of bristle strips 10 are mounted on the periphery of a rotary drum 12. Drum 12 is conventionally mounted on a large vehicle (not shown) designed specifically to rotate the drum to sweep snow, debris and the like from a surface transversed by the vehicle. An example is a street sweeper.

Each bristle strip includes a bristle mat 14 deformed into a generally U-shape during the manufacturing process. An elongated wire 16 extends the full length of the bristle mat at the inner part of the U-shaped loop for holding the bristle mat uniformly in place in a deformed metal strip 18. The deformed metal strip 18, bristle mat 14 and wire 16 comprise the preferred embodiment of the invention which are combined in unique fashion and then mounted in conventional slide elements mechanically secured to the periphery of the rotary drum 12.

Figure 6:
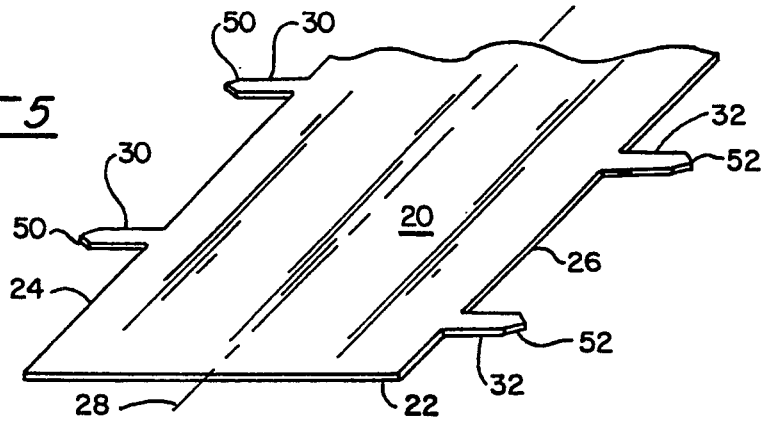
FIG. 6 is a fragmentary perspective view of a metal strip used in making the bristle strip of this invention.

The deformed metal strip 18 is initially a flat metal strip 20 as illustrated in FIG. 6 having a near end 22, side edges 24 and 26, and a centerline 28.

Projecting transversely from each side edge 24, 26 are a plurality of prongs 30, 32, which project from each side edge in co-planer fashion with the strip 20.

Figure 7:
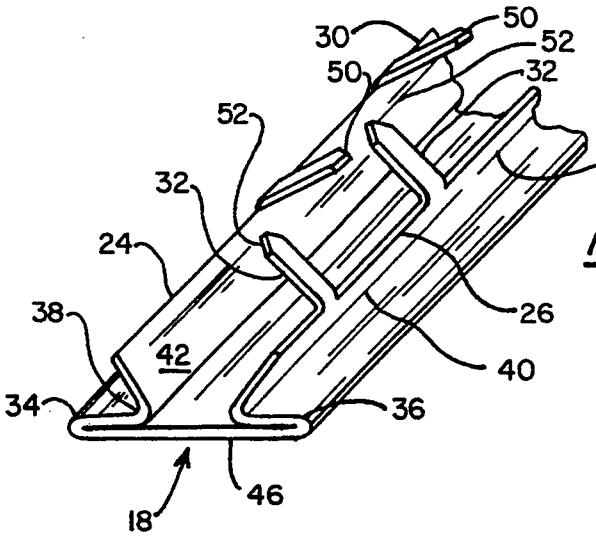
FIG. 7 is a fragmentary perspective view of the strip of FIG. 6 deformed to an intermediate shape as part of the process for forming the channel which carries the bristles.

Looking to FIG. 7, the transverse sides are folded over on themselves about 180 degrees toward the centerline 28 to form a double layer of metal strip to serve as parallel guide members or ears 34, 36. A pair of intermediate folds 38, 40 further deform the strip 20 to form a pair of upstanding flanges 42, 44.

Figure 8:
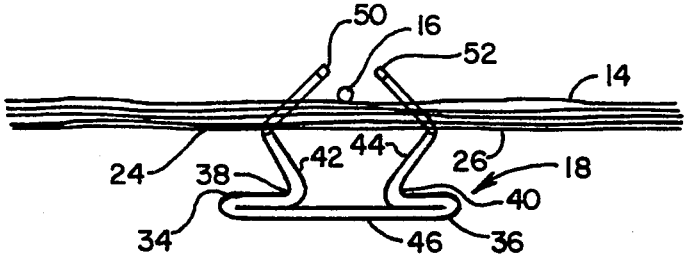
FIG. 8 is a schematic end elevational view of the intermediate shape of FIG. 7, a bristle mat and a holding wire during the manufacturing process.
Figure 9:
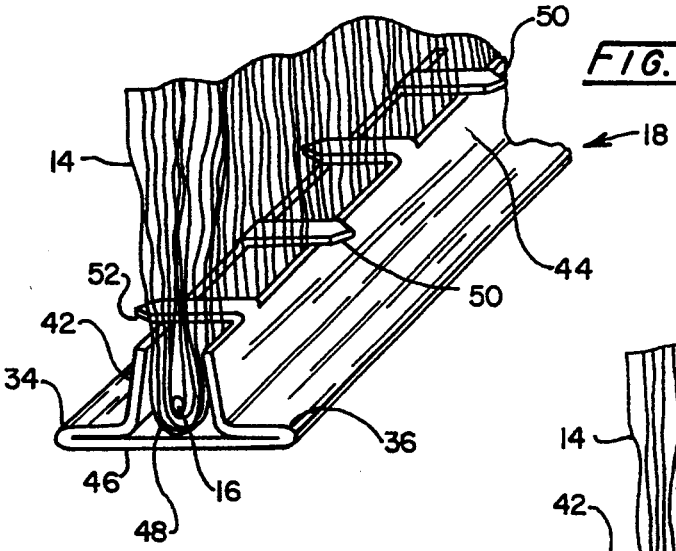
FIG. 9 is a fragmentary perspective view of the channel of FIG. 8 after it is formed from the flat strip, bristle mat and wire as a succeeding intermediate manufacturing step.
Figure 10:
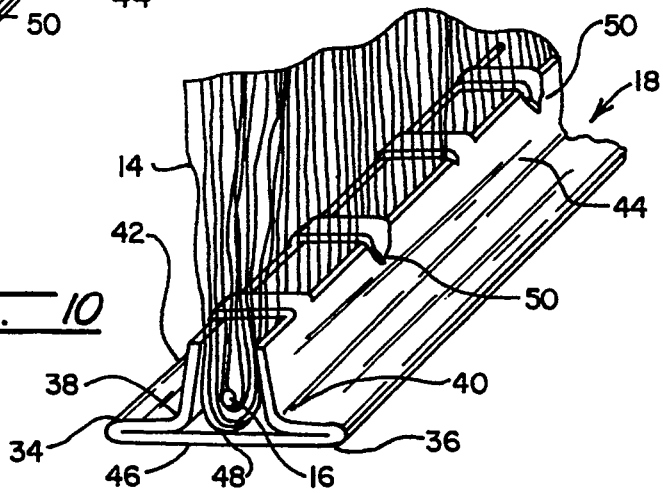
FIG. 10 is a fragmentary perspective view similar to FIG. 9 with flange retaining means deformed into operative position.

The intermediate manufacturing steps illustrated in FIGS. 7 and 8 show the flanges diverging upwardly from the flat base 46 of strip 18 and the purpose is to allow the easy insertion of the bristle mat 14 which is deformed and pushed into place by the elongated wire 16 illustrated best in FIG. 8. After the wire 16 and bristle mat 14 are pushed downwardly such that the closed lower end or bottom 48 of the U of the bristle mat 14 is in engagement with the flat base 46, flanges 42, 44 are crimped inwardly in an arc toward the centerline 28 such that they converge in an upwardly direction away from flat base 46. The wire 16 is located below the upper extension of flanges 42, 44. This inward crimping serves to hold the bristle mat 14 within the channel or trough formed by the deformed metal strip 18. To further secure the flanges 42, 44 in this relatively stationary position, the tip ends 50, 52 of tabs 30, 32 are crimped over to provide a mechanical engagement with the opposite flange. Thus, the flanges 42, 44 become relatively immobile and cannot easily spring open to allow the bristle strip 10 to be flipped out of operative position upon the rotation of the drum 12 adjacent some surface to be swept.

It will be observed that the tip ends 50, 52 of tabs 30, 32 are tapered at their tip ends and the purpose is to provide smooth sliding penetration through the many bristles of the bristle strip 10 without pushing the bristles out of their desired projection area.

FIG. 3 illustrates a conventional slide to receive bristle strip 10 where two facing U-shaped metal elements 54, 56 are welded or otherwise mechanically secured to the surface of a drum 12 and configured to receive the ears 34, 36 of deformed metal strip 18 to hold the bristle strip 10 in relatively stationary position on the drum 12.

Figure 4:
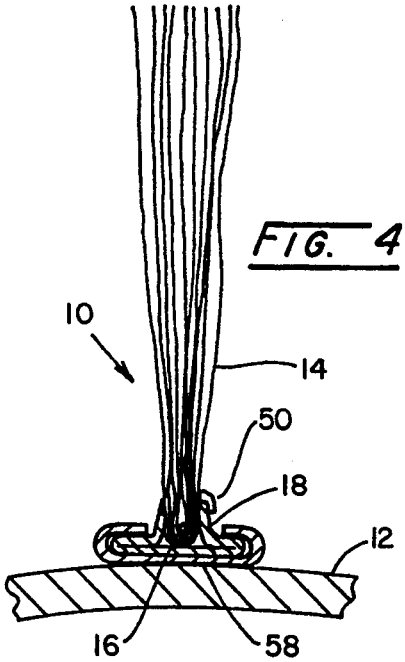
FIG. 4 is a sectional view similar to FIG. 3 showing a different form of track with the bristle strip of this invention inserted.

FIG. 4 indicates an alternative embodiment where the slide 58 is formed of a single piece rather than the two facing elements 56, 54 of FIG. 3.

Figure 5:
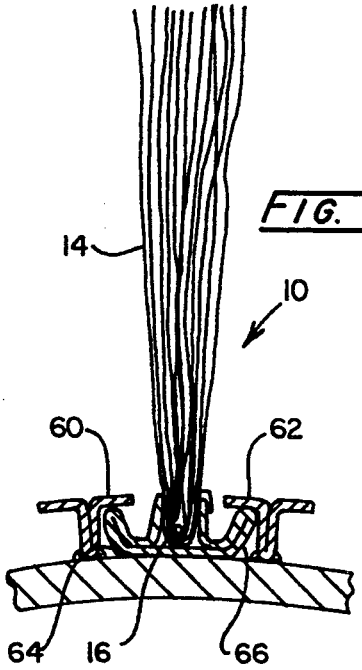
FIG. 5 is a sectional view similar to FIG. 3 showing the bristle strip slightly modified and inserted into a different form of track.

FIG. 5 illustrates yet another embodiment where the retaining elements 60, 62 are in the form of T-shaped metal retainers and the retaining ears 64, 66 are deflected upward to fill the cavity formed by the retaining T-shaped elements 60, 62. The particular structure illustrated in FIG. 5 allows a certain amount of resilient flexing of the bristle strip 10 along its length.

Figure 11:
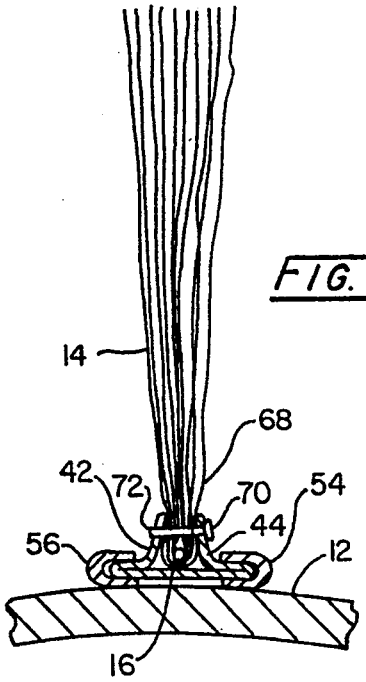
FIG. 11 is a fragmentary sectional view of a drum mounted bristle strip similar to the bristle strip of FIG. 10 but with an alternative flange retaining means.

FIG. 11 illustrates an alternative embodiment for the function of tabs 30, 32. It substitutes a nail 68 having a head 70 on one end. In the manufacturing operation, after the flanges 42, 44 are deformed into crimping position, nail 68 is driven through the flanges until the head 70 engages one flange. Thereafter the pointed end 72 of the nail 68 is bent over to be parallel with flange 42, and thereby, the head 70 and deformed pointed end 72 hold the flanges in operative position for the purpose described in relation to prongs 30, 32.

Figure 12:
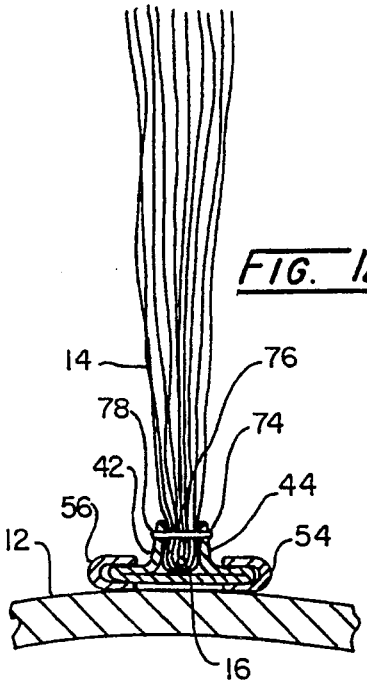
FIG. 12 is a fragmentary sectional view similar to FIG. 11 but showing another form of the flange retaining means of this invention.

FIG. 12 illustrates yet another alternative embodiment for retaining the flanges 42, 44 in place. It comprises a staple having a bridge 74 on one end and a pair of parallel prongs 76 projecting through holes in both flanges. Similar to the nail 68, the penetrating ends 78 of the staple are bent over sideways generally parallel with flange 42 to hold the flanges in place.

Having thus described the invention in its preferred embodiment, it will be clear that other modifications may be made without departing from the spirit of the invention. Also the language used to describe the inventive concept and the drawings accompanying the application to illustrate the same are not intended to be limiting on the invention. Rather it is intended that the invention be limited only by the scope of the appended claims.

I claim:

1. A process for making a bristle strip comprising, providing a flat elongated metal strip having a length greater than its width, said strip including a centerline along its length equidistant between its side edges, folding each side of said strip upward and toward said centerline to form two double layers of said strip to serve as guiding and mounting ears, deflecting the edge areas of each of said folded sides away from said centerline to form a trough with sides diverging from said centerline in an upward direction, placing an elongated U-shaped bristle mat in said trough with a retaining wire confined in the closed end of said U-shape, said wire being aligned parallel with said centerline, crimping said trough sides together to clamp said bristle mat in said trough with said trough sides converging toward said centerline in an upward direction, and mechanically joining said trough sides together to prevent spreading of said trough sides.

2. The method of claim 1 wherein said mechanical joining step includes driving a nail through both trough sides above said wire and deflecting the pointed end of said nail to lie against one of said trough sides.

3. The method of claim 1 wherein said mechanical joining step includes driving a U-shaped staple through both trough sides above said wire and deflecting the ends of said staples to lie against one of said sides.

4. The method of claim 1 wherein said mechanical joining step includes forming a tab projecting from the edge of one trough side, pushing said tab through said bristle mat above said wire, and deforming said tab into a mechanical engagement with the other of said trough sides.

5. The method of claim 4 including forming the end of said tab with a taper to facilitate pushing it through said bristle mat.

6. The method claim 1 wherein said mechanical joining step includes forming tabs on each edge of each trough side, pushing each tab through said bristle mat above said wire, and deforming said tabs into mechanical engagement with the other of said trough sides.

7. The method of claim 6 including forming said tabs uniformly spaced along said strip and alternatively, first on one trough edge and then on the other trough edge.

8. The method of claim 7 including forming the ends of said tabs with a taper to facilitate pushing them through said bristle mat.

* * * * *